US006390935B1

(12) United States Patent
Sugimoto

(10) Patent No.: US 6,390,935 B1
(45) **Date of Patent: *May 21, 2002**

(54) THREE-PIECE GOLF BALL

(75) Inventor: Kazushige Sugimoto, Hyogo-ken (JP)

(73) Assignee: Sumitomo Rubber Industries, Limited, Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/413,866

(22) Filed: Oct. 7, 1999

(30) Foreign Application Priority Data

Oct. 7, 1998 (JP) ..... 10-285704

(51) Int. Cl.[7] ..... A63B 65/06
(52) U.S. Cl. ..... 473/373; 473/374
(58) Field of Search ..... 473/373, 374, 473/376, 367, 368

(56) References Cited

U.S. PATENT DOCUMENTS 4,714,253 A * 12/1987 Nakahara et al. ..... 473/373
5,490,674 A * 2/1996 Hamada et al. ..... 473/373
5,711,723 A * 1/1998 Hiraoka et al. ..... 473/374
5,935,022 A * 8/1999 Sugimoto et al. ..... 473/373
6,045,459 A * 4/2000 Sugimoto et al. ..... 473/373

FOREIGN PATENT DOCUMENTS

| | | |
|---|---|---|
| GB | 2232162 | 12/1990 |
| GB | 2245580 | 1/1992 |
| GB | 2300574 | 11/1996 |
| GB | 2316626 | 3/1998 |
| JP | 59194760 | 11/1984 |
| JP | 1057523 | 3/1998 |

* cited by examiner

*Primary Examiner*—Mark S. Graham
*Assistant Examiner*—Raeann Gorden
(74) *Attorney, Agent, or Firm*—Birch, Stewart, Kolasch & Birch, LLP

(57) ABSTRACT

The present invention provides a three-piece golf ball which has an improved controllability at an approach shot while maintaining a long flight distance inherent to a solid golf ball. In the three-piece golf ball, the hardness, the specific gravity, and deformation amounts of the center and the core are determined in consideration of the relationship between each other.

5 Claims, 1 Drawing Sheet

THREE-PIECE GOLF BALL

BACKGROUND OF THE INVENTION

1. Field of the Invention

The present invention relates to a three-piece golf ball suitable for both skilled golfers and high handicap players. More specifically, the present invention relates to a three-piece golf ball which has an improved controllability at an approach shot and an improved shot feeling while maintaining excellent flight performance inherent to a solid golf ball.

2. Description of the Prior Art

Hitherto, a thread-wound golf ball and a two-piece golf ball have been generally used. A thread-wound golf ball comprises a core formed by winding a rubber thread around a solid rubber ball (i.e. a solid center) or a rubber bag filled with a liquid (i.e. a liquid center), and a cover enclosing the core. A conventional two-piece golf ball comprises a core made of rubber, and a cover enclosing the core and the core is made of synthetic resin such as ionomer.

A thread-wound golf ball provides a good shot feeling (i.e. soft feel when hitting the ball) because of the cover made of a soft material such as balata and has an excellent controllability due to high spin rate. However, the thread-wound golf ball may not attain a long flight distance in a head wind, especially when hit by golf players with a low club head speed including beginner, female, and the like. Moreover the thread-wound golf ball is poor in durability.

On the other hand, two-piece golf balls have superior durability to thread-wound golf balls and may attain a long flight distance in a head wind, since two-piece golf balls have high resilience and show difficulty to impart intentional spin. Higher resilience can lead to longer flight distance, however the difficulty to impart the spin on the two-piece golf ball causes poor controllability, for example a long run on a green at an approach shot.

A long flight distance is beneficial to high handicap players, and therefore they prefer golf balls having high resilience. Contrarily, excellent controllability is beneficial to more skilled players, especially professional golfers, and therefore they prefer golf balls on which intentional spin can be imparted. Since conventional two-piece golf balls cannot satisfy both the goals of a long flight distance and good controllability, two kinds of two-piece golf balls are produced: one can attain a long flight distance with poor controllability, and the other can provide a good controllability with sacrificing long flight distance.

However, there is a large demand for a golf ball which has a good controllability while maintaining a sufficient flight distance. As a golf ball which meets this demand, three-piece golf balls have been suggested. A three-piece golf ball comprises a core consisting of an center, an outer shell placed on the center, and a cover placed on the outer shell.

For example, Japanese Unexamined Patent Publication No. 59-194760 discloses a three-piece golf ball. In the three-piece golf ball, the hardness of the center is increased from the center point toward a surface of the center, and the specific gravity of the center is larger than that of the outer shell. The three-piece golf ball is liable to spin comparing with a two-piece golf ball, but cannot attain a sufficient flight distance to satisfy golfers who desire a long flight distance, especially when hit by a driver. Japanese Unexamined Patent Publication No. 10-57523 also suggests a three-piece golf ball in which the specific gravity of the center is smaller than that of the outer shell. In the three-piece golf ball, the ratio of deformation amount of the core (the center and the outer shell placing on the center) to that of the center alone (i.e. the deformation amount of the core/the deformation amount of the center alone) is in the range of 0.75 to 1. The three-piece golf ball has a such property that there is small difference between the hardness at a surface of the core and the hardness at the center point of the center, and has high spin rate. As a result, a flight distance is impaired, and therefore golfers who desire a longer flight distance cannot be satisfied with the three-piece golf ball.

In order to solve the problems of conventional three-piece golf balls, the present invention provides a three-piece golf ball which can offer an excellent controllability and a good shot feeling, and also can attain a long flight distance.

SUMMARY OF THE INVENTION

The present invention provides a three-piece golf ball which comprises a center having a diameter($d_1$) of 27 to 37 mm and a specific gravity (a), an outer shell placed on the center and having a larger specific gravity (b) than the specific gravity (a), and a cover placing on the outer shell and having a Shore D hardness of less than 60. The center has a JIS-C hardness (X) at the center point thereof and a JIS-C hardness (Y) at a surface thereof satisfying the equation: $(Y-X) \geqq 8$. The center and the outer shell constitute the core of the three-piece golf ball, and the core has a JIS-C hardness (Z) at a surface thereof being 80 or larger. When a load from 10 kgf as an initial load to 130 kgf as a final load apply to the center and the core respectively, a deformation amount (p) of the center and a deformation amount (q) of the core satisfy the equation: $(p-q) \geqq 0.5$.

DETAILED DESCRIPTION OF THE INVENTION

Figure 1:
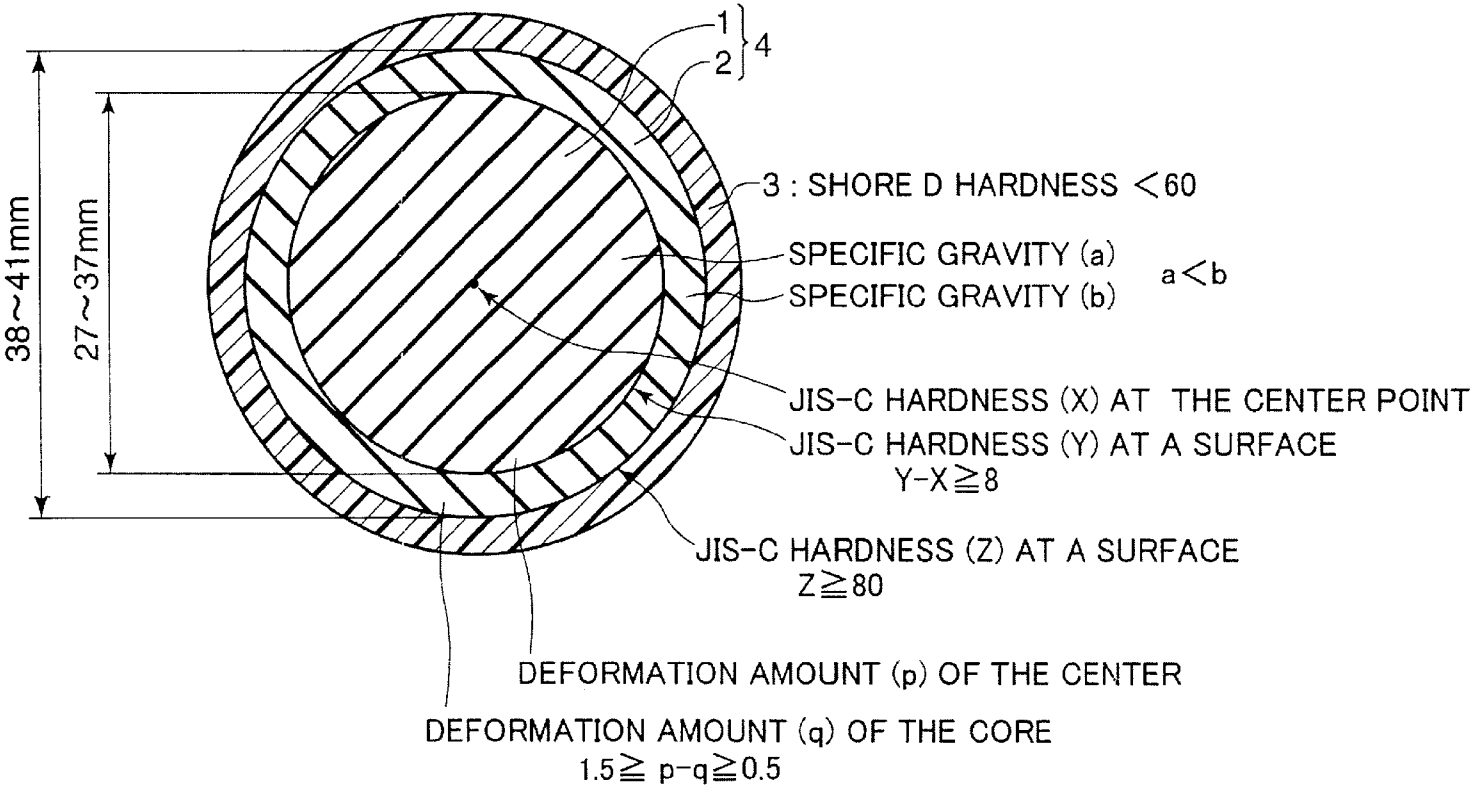
FIG. 1 is a cross sectional view of a three-piece golf ball of the present invention. The three-piece golf ball comprises an center 1, an outer shell 2 placing on the center 1 and a cover 3 placing on the outer shell 2. The center 1 and the outer shell 2 constitute a core 4.

Hereinafter, the respective elements of the three-piece golf ball of the present invention (i.e. the center 1, the outer shell 2 and the cover 3) will be described.

First, the center 1 will be described. The center 1 is made of a material containing rubber as a main component, and has a diameter ($d_1$) of 27 to 37 mm. The resilience of the golf ball is mainly determined by the resilience of the center 1. For the purpose of ensuring higher resilience of the golf ball, the diameter ($d_1$) should be 27 mm or more. In addition, in order to lessen impact to a player when hitting the golf ball and provide a good shot feeling, the diameter ($d_1$) of at least 27 mm is necessary to vary the hardness of the center 1 from its center point to its surface mildly. On the other hand, considering the standard size of a golf ball, it is necessary to decrease the thickness of the outer shell 2 as the diameter ($d_1$) increases. In order to obtain a sufficient effect of comprising the outer shell 2 in the golf ball, the upper limit of the diameter ($d_1$) is required to be 37 mm.

As long as the equations required in the present invention, the hardness of the center 1 may vary as follows: the hardness is gradually increased from its center point to its surface; the hardness is gradually increased from its center point to the middle point of the center 1 (i.e. at the point corresponding to the diameter of about 15 mm), and decreased gradually from the middle point to the surface such that the hardness at the surface is kept higher than that of the center point.

According to the invention, a JIS-C hardness of the center point of the center 1 (hereinafter, referred to as "a center point hardness (X)") and a JIS-C hardness at a surface of the center 1 (hereinafter, referred to as "a center surface hardness (Y)") satisfy the equation: $(Y-X) \geqq 8$, preferably satisfy the equation: $(Y-X) \geqq 10$. If (Y−X) is smaller than 8 by increasing the center point hardness (X), the resulting golf ball gives a heavy shot feeling when hit by a golf club, for example a driver, having such a property that the shot feeling largely depends on the hardness of the center point of the golf ball. Players feel the shot feeling heavy in the case that the contact time of the golf ball and the club head is longer after hitting the ball. If (Y−X) is smaller than 8 by decreasing the center surface hardness (Y) while a JIS-C hardness (Z) at a surface of the core 4 (hereinafter, referred to as "core hardness (Z)") is 80 or larger, the difference between the center surface hardness (Y) and the hardness of the outer shell layer 2 alone becomes too large. The resulting golf ball exhibit poor durability and cannot attain a long flight distance due to too large back spin. The preferable upper limit of (Y−X) is 25 or smaller, and more preferably 20 or smaller as a following reason. If (Y−X) becomes too large by decreasing the center point hardness (X), the resulting golf ball has poor resilience. If the difference (Y−X) becomes too large by increasing the center surface hardness (Y), the shot feeling of the resulting golf ball becomes worse.

In order to adjust the difference between the center surface hardness (Y) and the center point hardness (X), i.e. (Y−X), within the range of 8 to 25 and being the core surface hardness of 80 or larger, the center point hardness (X) is preferably 55 to 75, and more preferably 58 to 72. If the center point hardness (X) is smaller than 55, the center 1 becomes too soft and the resilience of the golf ball is lowered. Contrary to this, if the center point hardness (X) is larger than 75, the center 1 becomes too hard and the shot feeling of the golf ball becomes worse. The center surface hardness (Y) is preferably 70 to 90, and more preferably 73 to 87. If the center surface hardness (Y) is smaller than 73, the center 1 becomes too soft and the resilience of the golf ball is lowered. Contrary to this, if the center surface hardness (Y) is larger than 87, the center 1 becomes too hard and the shot feeling of the golf ball is impaired.

The specific gravity of the center 1 (hereinafter, referred to as "specific gravity (a)") is preferably 1.0 to 1.2, and more preferably 1.00 to 1.15, and the most preferably 1.00 to 1.10. The reason why the specific gravity (a) is made to 1.0 or larger is as follows. The center 1 is made of a rubber composition containing diene rubber as a main component and vulcanizing agents such as peroxide. The diene rubber usually has a specific gravity of about 1.0, and a conventional vulcanizing agent has a specific gravity of 1.0 or larger. When the diene rubber and the vulcanizing agent are blended to prepare the rubber composition, the specific gravity of the rubber composition inevitably becomes 1.0 or larger. Therefore, it is difficult to adjust the specific gravity (a) of the center 1 to less than 1.0, unless hollow portions or vacancies are formed in the center 1. The preferable upper limit of the specific gravity (a) is 1.2, because in order to increase resilience, it is necessary to use large amount of the rubber and small amount of fillers to prepare the composition for the center 1.

When a load ranging from 10 kgf as an initial load to 130 kgf as a final load is applied onto the center 1, the deformation amount of the center 1 (hereinafter, referred to as "center deformation amount (p)") is preferably 3.0 to 5.0 mm, and more preferably 3.75 to 4.35 mm. If the center deformation (p) is less than 3.0 mm, the center 1 is too hard to provide the golf ball giving a good shot feeling because of giving a big impact to the player. If the center deformation (p) is larger than 5.0 mm, the center 1 is soft enough to deform exceedingly when the ball is hit, thereby being liable to detach from the hard cover 3 by repeated hit and causing impairing durability of the golf ball.

The center 1 is made of a vulcanized rubber composition which contains a base rubber, a vulcanization initiator and a crosslinking agent, but other material may be used as far as it satisfies the above-described requirements.

As the base rubber in the center composition, either a natural rubber or a synthetic rubber may be used as far as it is diene rubber conventionally used for a core of a solid golf ball. Examples of synthetic rubber include ethylene propylene diene terpolymer (EPDM), butadiene rubber (BR), isoprene rubber (IR), styrene butadiene rubber (SBR), and acrylonitrile butadiene rubber (NBR). These may be used alone or in combination of two or more of them. Among them, preferable is cis-1,4-polybutadiene having 40 percent or more, and more preferably 80 percent or more of cis 1,4-bonds.

As the vulcanization initiator, an organic peroxide is used. Examples of the organic peroxide include dicumyl peroxide, 1,1-bis(t-butylperoxy)-3,5-trimethyl cyclohexane, 2,5-dimethyl-2,5-di(t-butyl peroxy)hexane, and di-t-butylperoxide. Among them, dicumyl peroxide is preferable. The amount of the organic peroxide is preferably 0.3 to 2.0 parts by weight, and more preferably 0.5 to 2.0 parts by weight per 100 parts by weight of the base rubber.

As the co-crosslinking agent, an α,β-unsaturated carboxylic acid having 3 to 8 carbon atoms or a metal salt thereof are used. Preferred is the α,β-unsaturated carboxylic acid such as acrylic acid and methacrylic acid, and the univalent or divalent metal salts such as zinc salt or magnesium salt Among them, zinc acrylate is more preferable because it imparts high resilience to the resulting golf ball. The amount of the α, β-unsaturated carboxylic acid or metal salt thereof is preferably 20 to 40 parts by weight, and more preferably 25 to 35 parts by weight, and the most preferably 24 to 33 parts by weight per 100 parts by weight of the base rubber. If the amount is larger than 40 parts by weight, the rubber composition is crosslinked too densely to produce the center 1 having a hardness of 75 or smaller. Contrary to this, if the amount is smaller than 20 parts by weight, the center composition is not crosslinked enough to produce a center having a sufficient resilience as a solid golf ball.

On top of the above-described essential components, the rubber composition for the center may contain additives which have been conventionally used for forming a core of solid golf balls, if necessary. Examples of the additives include a specific gravity adjuster, an antioxidant, a plasticizer, a dispersant, a UV absorber, a colorant, and a peptizer. In order to attain high resilience without impairing the shot feeling, an organic sulfide compound such as diphenyl disulfide may be admixed.

Next, the outer shell 2 will be described.

The thickness of the outer shell 2 is preferably 1 to 14 mm, and more preferably 2 to 6 mm, considering that the center 1 has a diameter ($d_1$) of 27 to 37 mm, and the core 4 has a diameter ($d_2$) of 38 to 41 mm.

According to the present invention, the outer shell 2 has a specific gravity (b) which is larger than the specific gravity (a) of the center 1 for the following reason. In order to achieve higher resilience of the golf ball, the preferable upper limit of the specific gravity (a) is 1.2, since the center 1 has an important influence on the resilience of the golf ball. Therefore, in order to have the resulting golf ball meet the standard weight, it is necessary to produce the outer shell having a specific gravity (b) which is larger than the specific gravity (a). Even if the rubber content in the outer shell composition is decreased, no problem occurs because the specific gravity (b) has less influence on the resilience of the golf ball than the one of the center 1. The difference between the specific gravity (a) and the specific gravity (b) is preferably 0.1 or larger (i.e. $(b-a) \geqq 0.1$), and more preferably 0.15 or larger (i.e. $(b-a) \geqq 0.15$). The upper limit of (b−a) is preferably 0.3, and more preferably 0.25. Preferable specific gravity (b) is in the range of 1.10 to 1.35, and more preferably 1.15 to 1.30. If (b−a) is less than 0.1 while having the resulting golf ball met the standard weight, the content of the base rubber in the center composition is required to be decreased such that the specific gravity (a) is under 1.2. The resulting golf ball does not have sufficient resilience to attain a long flight distance. On the other hand, if the (b−a) is larger than 0.3, the specific gravity (b) should be larger than 1.30 because the center has usually a specific gravity (a) of at least 1.0. Using the outer shell having the specific gravity (b) of larger than 1.3, it is difficult to produce the golf ball having a weight under the standard maximum weight limitation (45.92 kg).

As the material for the outer shell 2, a rubber composition comprising a base rubber, a vulcanization initiator, a co-crosslinking agent, and a specific gravity adjuster are used, but it is not limited thereto as far as it satisfies the above requirements and requirements for the core 4 described below.

Above-mentioned three materials (base rubber, vulcanization initiator, and co-crosslinking agent ) used in the center composition may be also used in the rubber composition for the outer shell 2. On top of the three materials, the specific gravity adjuster is blended in the outer shell composition in order to have the specific gravity (b) of the outer shell 2 adjusted in the range of 1.10 to 1.35. As the specific gravity adjuster, an inorganic salt such as zinc oxide, barium sulfate, calcium carbonate; metal powders of zinc oxide, barium sulfate, and/or tungsten; and a mixture of two or more of them may be used. Even if the same kind of base rubber, vulcanization initiator, and co-crosslinking agent as those employed for the center 1 are used in the outer shell composition, the outer shell 2 may have various hardness by changing their blending ratio and vulcanization conditions (e.g. vulcanizing temperature, vulcanizing time or the like).

On top of the above components, additives which are conventionally used for producing a core of solid golf balls may be admixed in the outer shell composition, if necessary. Examples of the additives include an antioxidant, a plasticizer, a dispersant, a UV absorber, a colorant, and a peptizer. In order to attain higher resilience without impairing the shot feeling, an organic sulfide compound such as diphenyl disulfide may be added.

The center 1 is covered with the outer shell 2 to form the core 4. That is, the core 4 of the present invention consists of the center 1 which has a diameter ($d_1$) of 27 to 37 mm, a specific gravity (a), a center surface hardness (Y) and a center point hardness (X) satisfying the equation: $(Y-X) \geqq 8$, and a deformation amount (p) of the center when applying a load from 10 kgf as an initial load to 130 kgf as a final load thereto; and the outer shell 2 which has a larger specific gravity (b) than the specific gravity (a). And the core 4 has a JIS-C hardness (Z) at a surface thereof being 80 or larger and a deformation amount (q) of the core when applying a load from 10 kgf as an initial load to 130 kgf as a final load thereto, and the deformation amount (q) satisfying the equation: $(p-q) \geqq 0.5$.

According to the present invention, the JIS-C hardness (Z) at a surface of the core 4 (corresponding to a hardness at a surface of the outer shell 2, simply referred to as "a core hardness (Z)") is 80 or more, preferably 82 or more. If the core hardness (Z) is less than 80, the resulting golf ball does not have sufficient resilience to attain a long flight distance. The core hardness (Z) is preferably 95 or smaller, more preferably 90 or smaller. If the core hardness (Z) is larger than 95, the core 4 becomes too hard to provide a golf ball giving a good shot feeling. The difference between the core harness (Z) and the center point hardness (X) is preferably 10 or more (i.e. $(Z-X) \geqq 10$), and more preferably 15 or more (i.e. $(Z-X) \geqq 15$), and the most preferably 20 or more (i.e. $(Z-X) \geqq 20$). The preferable upper limit of (Z−X) is 35, and more preferably 30. If (Z−X) is less than 10, the resulting golf ball flies at a low launch angle and high spin rate especially when hit by a driver, a middle iron and a long iron. Consequently, a long flight distance cannot be attained. Contrary to this, if (Z−X) is larger than 35, the center point hardness (X) differ greatly from the hardness of the outer shell 2 alone. In this case, the center 1 is soft enough to deform greatly, but the outer shell 2 cannot deform as much as the center 1. Thereby the center 1 is liable to detach from the outer shell 2 and resulting in poor durability.

When a load ranging from 10 kgf as an initial load to 130 kgf as a final load is applied onto the center 1 and the core 4, the respective amounts of deformation thereof are simply referred to as "a center deformation (p)" and "a core deformation (q) respectively. According to the present invention, the core deformation (q) is smaller than the center deformation (p), and the center deformation (p) and the core deformation (q) satisfy the equation: $(p-q) \geqq 0.5$, preferably satisfy the equation: $(p-q) \geqq 0.65$. If (p−q) is less than 0.5, the golf ball flies at a low launch angle and high spin rate especially when hit by a driver, and thereby a long flight distance cannot be attained. The preferable upper limit of (p−q) is 1.50, and more preferably 1.00. If (p−q) is larger than 1.50, the resulting golf ball is poor in durability because the center 1 is liable to detach from the outer shell 2.

As mentioned above, the preferred core 4 which has a diameter ($d_2$) of 38 to 41 mm and consists of a center having a diameter ($d_1$) of 27 to 37 mm, a specific gravity (a), a JIS-C hardness (X) at the center point thereof, JIS-C hardness (Y) at a surface thereof satisfying the equation: $8 \leqq (Y-X) \leqq 25$, and a deformation amount (p) of the center when applying a load from 10 kgf as an initial load to 130 kgf as a final load to the center; and an outer shell placed on the center, having specific gravity (b) satisfying the equation: $0.1 \leqq (b-a) \leqq 0.3$. The core has a JIS-C hardness (Z) of 80 or larger, which satisfies the equation: $10 \leqq (Z-X) \leqq 35$, and a deformation amount (q) of the core satisfies the equation: $0.5 \leqq (p-q) \leqq 1.5$, when applying a load from 10 kgf as an initial load to 130 kgf as a final load thereto.

Next, the cover 3 will be described.

The cover 3 is usually made of a material containing ionomer as a main component. A shore D hardness of the cover 3 (hereinafter, simply referred to as "a cover hardness D") is less than 60, and preferably 58 or less. If the cover hardness D is not less than 60, the sufficient spin to stop quickly on green cannot be put on the golf ball at an approach shot. The preferable lower limit of the cover hardness D is 45, and more preferably 48. The softer cover (i.e. the cover hardness D is smaller than 45) allows to impart too high spin on the golf ball when hit by a driver, a long iron, or a middle iron. As a result, a long flight distance cannot be attained.

The thickness of the cover 3 is preferably 0.9 to 2.4 mm, and more preferably 1.5 to 2.3 mm, considering the standard size of the golf ball and the above-mentioned size of the core 4.

The material for the cover 3 is not specifically limited as far as it satisfies the above requirements. Preferably, a composition containing ionomer as a main component is used.

Ionomers are copolymers of an olefin and an α, β-etylenically unsaturated carboxylic acid with a portion of the carboxylic acid groups neutralized by a metal ion. The metal ions are univalent metal ions such as sodium ion, potassium ion, and lithium ion; divalent metal ions such as zinc ion calcium ion, magnesium ion, copper ion, and manganese ion; trivalent metal ions such as aluminum ion, and neodymium ion. Preferred are sodium ion and lithium ion, and magnesium ion, because they may provide a hard ionomer having high hardness and high resilience.

Specific examples of the ionomer include: ionomers sold by Mitui DuPont Chemical Co.,Ltd. such as Himilan® 1605 (an ionomer resin of sodium ion-neutralized ethylene-methacrylic acid copolymer), Himilan® 1707 (an ionomer resin of a sodium ion-neutralized ethylene-methacrylic acid copolymer), Himilan® 1706 (an ionomer resin of a zinc ion-neutralized ethylene-methacrylic acid copolymer), Himilan® AM7315 (an ionomer resin of a zinc ion-neutralized ethylene-methacrylic acid copolymer), Himilan® AM7317 (an ionomer resin of a zinc ion-neutralized ethylene-methacrylic acid copolymer), Himilan(® 1555 (an ionomer resin of a sodium ion-neutralized ethylene-methacrylic acid copolymer), Himilan 1557 (an ionomer resin of a zinc ion-neutralized ethylene-methacrylic acid copolymer); ionomers sold by Exxon Chemical Co., Ltd such as Iotek® 8000 (an ionomer resin of a sodium ion-neutralized ethylene-methacrylic acid copolymer), Iotek® 7010 (an ionomer of a zinc ion-neutralized ethylene-methacrylic acid copolymer); ionomers sold by DuPont Co., Ltd such as Surlyn® 7930 (an ionomer resin of a lithium ion-neutralized ethylene-methacrylic acid copolymer), Surlyn® 8511 (an ionomer resin of a zinc ion-neutralized ethylene-methacrylic acid copolymer), Surlyn® 8512 (an ionomer resin of a sodium ion-neutralized ethylene-methacrylic acid copolymer), Surlyn® 8945 (an ionomer resin of a sodium ion-neutralized ethylene-methacrylic acid copolymer), and Surlyn 9945 (an ionomer resin of a zinc ion-neutralized ethylene-methacrylic acid copolymer).

The cover composition contains the above-mentioned ionomer as a main component, and preferably, further contains a thermoplastic elastomer because the thermoplastic elastomer can provide a softer cover which can deform in response to the deformation of the core 4. The thermoplastic elastomer is a block copolymer formed by bonding a polymer block which shows a freeze phase or a crystalline phase at a melting point or lower, or a polymer block in which the movement of the molecules is restricted by hydrogen bonding (i.e. hard segment), and a polymer block in which the movement of the molecules is not restricted under the melting point (i.e. soft segment). Defining the hard segment as H and the soft segment as S, H and S may link in the form of H-S, H-S-H, or a multi-block form or a star-form expressed by $(H\text{-}S)_n$. Specific examples of the thermoplastic elastomer include: polystyrene elastomers in which the hard segment is polystyrene, and the soft segment is selected from the group of polybutadiene, polyisoprene, and hydrogenated products thereof; polyolefin elastomers in which the hard segment is polyethylene or polypropyrene, and the soft segment is butyl rubber or ethylene-propyrene-diene terpolymer (EPDM); polyamide elastomers in which the hard segment is polyamide, and the soft segment is polyester or polyether; polyester elastomers in which the hard segment is polyester, and the soft segment is polyether; polyurethane elastomers in which the hard segment is a polyurethane block having urethane bonds, and the soft segment is polyester or polyether; elastomers in which polybutadiene block has epoxy groups, or elastomers in which polystyrene block has a hydroxyl group at the terminal thereof; and a mixture of two or more of these elastomers.

On top of the ionomer and the thermoplastic elastomer described above, the cover composition may further contain other additives, if necessary. Examples of the additives include a colorant, an antioxidant, a dispersant, and a UV absorber.

In the production of the three-piece golf ball, the center 1 is produced first, and the center 1 is covered with the outer shell 2 and the cover 3 in this order. The center 1 is formed by vulcanization in a mold under heat and pressure. The outer shell 2 and the cover 3 are formed by a conventional method for forming golf ball cover well known in the art, such as injection molding, compression molding and the like. In the compression molding, two preformed half-shells are prepared, and the molded center is put into one of them, and then the half-shells are combined together into a shape of ball to form the core. In forming the cover by the compression molding, the molded core is put into one of preformed half-shells made of cover material, and then the half-shells are combined together to form cover.

In forming a cover on the core, dimples or brambles are impressed onto the surface of the cover. After cover forming, paint finishing and mark stamping may be provided on the surface for serving commercial sale.

In the three-piece golf ball of the present invention, the hardnesses, the specific gravity, and deformation amounts of the center and the core are determined in consideration of the relationship between each other in order to provide the solid golf ball which can satisfy both of golfers desired a long flight distance and golfers desired an excellent controllability. In addition, the three-piece golf ball gives excellent shot feeling. Therefore, by use of three-piece golf ball of the present invention, players may obtain a long flight distance while receiving less impact. Furthermore the three-piece golf ball has excellent durability inherent to solid golf balls.

EXAMPLES

Methods of Measurement and Eevaluation

① Hardness (Degree)

a) JIS-C hardness of center and core

The hardness of the center was measured at the center point of the center, at points 5 mm, 10 mm and 15 mm from the center, and at a surface of the center. The hardness of the core was measured at the surface thereof.

The JIS-C hardness was measured by a C-type spring hardness meter in accordance with JIS-K6301.

b) Shore D hardness of cover

The hardness of a cover was measured at a surface of the golf ball produced described below by using a Shore D-type spring hardness meter in accordance with ASTM-D 2240-68.

② Amount of deformation (mm)

A load ranging from 10 kgf as an initial load to 130 kgf as a final load was applied to the center, and the deformation amount (p) of the center was measured. A load ranging from 10 kgf as an initial load to 130 kgf as a final load was applied to the core, and the deformation amount (q) of the core was measured.

③ Resilience

A metal cylinder was hit against the golf ball, and the resiliences of the cylinder and the golf ball were respectively measured at the moment of hit. The higher the measured value, the better the resilience was.

④ Flight Performance when Hit by a Driver

The golf ball was hit by a driver, and the launch angle, spin rate, flight distance (carry and total distance) were measured.

a) Launch Angle (°)

A W#1 driver having a metal head was mounted to a swing robot manufactured by True Temper Co., Ltd. and the golf ball was hit by the driver at a head speed of 45 m/sec. The angle immediately after the golf ball was hit was measured. The measurement was repeated 8 times, and the average value was obtained.

b) Spin (rpm)

A W#1 driver having a metal head was mounted to a swing robot manufactured by True Temper Co., Ltd. and the golf ball was hit by the driver at a head speed of 45 m/sec. The amount of back spin immediately after the golf ball was hit was measured. The measurement was repeated 8 times, and the average value was obtained.

c) Flight Distance (yard)

A W#1 driver having a metal head was mounted to a swing robot manufactured by True Temper Co., Ltd. and the golf ball was hit by the driver at a head speed of 45 m/sec. The distance from the point where the ball was hit to the point where the ball fell to the ground was measured (i.e. carry). At the same time, the distance from the point where the ball fell to the ground to the point where the ball stopped was measured (i.e. run). The carry and the run was summed up to obtain the total distance. The measurement was repeated 5 times, and the average value was obtained.

⑤ Controllability when Hit by an Iron

The controllability was evaluated from the amount of spin, and a flight distance (i.e. carry and run).

A spin rate and a flight distance were measured respectively in the same manner as those when hit by a driver with the exception that an iron (SW) was used instead of a driver and the ball was hit at an initial speed of 21 m/sec.

⑥ shot feeling

Each of ten professional golfers hit the golf ball using a W#1 driver having a metal head, and judged the shot feeling under the following criteria. The most prevailing judge was adopted as the shot feeling of the golf ball.

⊙: the impact was very small (very soft feel);

○: the impact was small (soft feel);

Δ: the impact was not small (rather hard feel); and

×: the impact was very large (hard feel).

Production of Golf Ball

The center for the golf ball of Example 1 was prepared by the following steps. The rubber composition for the center shown in Table 1 was uniformly kneaded by a kneading roll, and then, was vulcanized and molded to form a center in the spherical shape having a diameter ($d_1$) of 28 mm. Repeating these steps, the centers of the golf balls of Examples 2 to 4 in the spherical shape having a diameter ($d_1$) of 28 to 35 mm were produced using the compositions shown in Table 1, and the centers of Comparative Examples 1 to 7 in the spherical shape having a diameter ($d_1$) of 25 to 35 mm were produced using the compositions shown in Table 2. The JIS-C hardness, specific gravity, and amount of deformation of the respective centers were measured by the methods described above. The results of measurement for the centers of Examples 1 to 4 are shown in Table 4, and those for Comparative Examples 1 to 7 are shown in Table 5.

Next, the core of the golf ball of Example 1 was formed by the following steps. By use of the composition for the outer shell shown in Table 1, the outer shell was formed on the center by injection molding. As a result, a core having a diameter ($d_2$) of 39.1 mm was produced. Repeating these steps, the core of the golf balls of Examples 2 to 4 having a diameter ($d_2$) of 39.1 mm were produced using the compositions shown in Table 1, and the core of Comparative Examples 1 to 7 were produced using the compositions shown in Table 2. The hardness at a surface and amounts of deformation of the respective cores were measured by the methods described above. The results of measurement for the core of Examples 1 to 4 are shown in Table 4, and those for Comparative Examples 1 to 7 are shown in Table 5.

Then, the cover of the golf ball of Example 1 was formed. By use of one of the cover compositions A to D shown in Table 3, the cover was formed on the core by injection molding. As a result, a three-piece golf ball having a diameter of 42.76 mm was produced. Repeating these steps, the three-piece golf balls of Examples 2 to 4 and Comparative Examples 1 to 7 were produced. The shore D hardness of cover, resilience, flight performance, controllability, and shot feeling of the respective golf balls were measured and evaluated by the methods described above. The results of measurement and evaluation for the golf balls of Examples 1 to 4 are shown in Table 4, and those for Comparative Examples 1 to 7 are shown in Table 5.

TABLE 1

| | Example | 1 | 2 | 3 | 4 |
|---|---|---|---|---|---|
| Center | Butadiene rubber | 100 | 100 | 100 | 100 |
| | Zinc Acrylate | 24 | 27 | 30 | 33 |
| | Zinc oxide | 6.77 | 55 | 42 | 33 |
| | D P D S | 0.4 | 0.4 | 0.4 | 1.0 |
| | Dicumyl peroxide | 1.4 | 1.4 | 1.4 | 0.7 |
| | Vulcanization | 152 × | 152 × | 152 × | 152 × 24 |
| | Temp.(° C.) × Time(min) | 24 | 24 | 24 | |
| Outer shell | Butadiene rubber | 100 | 100 | 100 | 100 |
| | Zinc acrylate | 30 | 30 | 30 | 30 |
| | Zinc oxide | 20 | 20 | 20 | 20 |
| | D P D S | 0.4 | 0.4 | 0.4 | 0.4 |
| | Dicumyl peroxide | 2.0 | 2.0 | 2.0 | 2.0 |
| | Tungsten | 13 | 13 | 13 | 13 |
| | Vulcanization | 157 × | 157 × | 152 × | 154 × 20 |
| | Temp.(° C.) × Time(min) | 20 | 20 | 20 | |
| Cover | | A | A | B | D |

TABLE 2

| | Comparative Example | 1 | 2 | 3 | 4 | 5 | 6 | 7 |
|---|---|---|---|---|---|---|---|---|
| Center | Butadiene rubber | 100 | 100 | 100 | 100 | 100 | 100 | 100 |
| | Zinc acrylate | 27 | 28 | 27 | 30 | 27 | 32 | 27 |
| | Zinc oxide | 5.5 | 20 | 5.5 | 4.2 | 5.5 | 3.4 | 5.5 |
| | DPDS | 0.4 | 0.4 | 0.4 | 0.4 | 0.4 | 0.4 | 0.4 |
| | Tungsten | — | 16 | — | — | — | — | — |
| | Dicumyl peroxide | 1.4 | 1.4 | 1.4 | 1.4 | 1.4 | 1.4 | 1.4 |
| | Vulcanization Temp (° C.) × Time (min) | 152 × 24 | 152 × 24 | 140 × 22 168 × 6 | 152 × 24 | 152 × 24 | 152 × 24 | 157 × 20 |
| Outer shell | Butadiene rubber | 100 | 100 | 100 | 100 | 100 | 100 | 100 |
| | Zinc acrylate | 30 | 30 | 30 | 30 | 30 | 30 | 30 |
| | Zinc oxide | 20 | 5 | 20 | 20 | 20 | 20 | 20 |
| | DPDS | 0.4 | 0.4 | 0.4 | 0.4 | 0.4 | 0.4 | 0.4 |
| | Dicumyl peroxide | 2.0 | 2.0 | 2.0 | 2.0 | 2.0 | 2.0 | 2.0 |
| | Tungsten | 13 | — | 13 | 13 | 13 | 13 | 13 |
| | Vulcanization Temp (° C.) × Time (min) | 157 × 20 | 152 × 20 | 152 × 20 | 146 × 20 | 154 × 20 | 149 × 20 | 157 × 20 |
| Cover | | A | A | A | A | C | A | A |

*In Comparative Example 3, the vulcanization was conducted at 140° C. for 22 minutes, and after that, at 160° C. for 6 minutes.

TABLE 3

| Cover composition | | A | B | C | D |
|---|---|---|---|---|---|
| Ionmer | Surlyn8945 | — | — | — | 25 |
| | Surlyn9945 | — | 20 | — | 25 |
| | Surlyn AD8542 | 20 | 30 | — | — |
| | Himilan1706 | 30 | — | — | — |
| | Himilan1555 | 30 | 25 | — | — |
| | Himilan1557 | — | — | 30 | — |
| | Himilan1707 | — | — | 20 | — |
| | Himilan1855 | — | — | 50 | — |
| Elastomer | Epofriend A1010 | 8 | 10 | — | 15 |
| | Septon HG252 | — | — | — | 35 |
| | Pebax2533 | 12 | 15 | — | — |
| Shore D hardness | | 58 | 55 | 63 | 51 |

As a base rubber for an center and an outer shell, BR11 (cis1,4-polybutadiene having 96% of cis1,4 bonds, a product of Nippon Synthetic Rubber Co., Ltd.) was used. In Tables 1 and 2, the term "DPDS" means diphyenyl sulfide, a product of Sumitomo Seika Co., Ltd.

As an ionomer for the cover, used were Himilan® 1707 (an ionomer resin of a sodium ion-neutralized ethylene-methacrylic acid copolymer), Himilan® 1706 (an ionomer of a zinc ion-neutralized ethylene-methacrylic acid copolymer), Himilan® 1555 (an ionomer of a sodium ion-neutralized ethylene-methacrylic acid copolymer), Himilan® 1557 (an ionomer resin of a zinc ion-neutralized ethylene-methacrylic acid copolymer), Surlyn® 8945 (an ionomer resin of a sodium ion neutralized ethylene-methacrylic acid copolymer), Surlyn® 9945 (an ionomer resin of a zinc ion neutralized ethylene-methacrylic acid copolymer), and Surlyn® 8542 (an ionomer resin of a magnesium ion neutralized ethylene-methacrylic acid copolymer). As a thermoplastic elastomer, used were Epofriend A1010 (a product of Daicel Chemical Industries Co., Ltd.), Septon HG252 (styrene elastomer, a product of Kuraray Co., Ltd.), and Pebax 2533 (polyamide elastomer, a product of ELF-ATOCHEM). Epofriend A1010 is a styrene elastomer which has polystyrene blocks as hard segment (referred to as "S") and polybutadiene block as soft segment (referred to as "B") and they are linked in the form of S-B-S and epoxidized.

TABLE 4

| Example | | | 1 | 2 | 3 | 4 |
|---|---|---|---|---|---|---|
| Center | JIS-C hardness | Center point (X) | 60 | 62 | 63 | 63 |
| | | 5 mm | 70 | 72 | 73 | 72 |
| | | 10 mm | 75 | 77 | 80 | 77 |
| | | 15 mm | 76 | 78 | 81 | 78 |
| | | Surface (Y) | 75 | 76 | 79 | 77 |
| | Y-X | | 15 | 14 | 16 | 13 |
| | Diameter ($d_1$) | | 28 | 32 | 35 | 30 |
| | Specific gravity (a) | | 1.05 | 1.05 | 1.05 | 1.05 |
| | Deformation amount (p) | | 4.35 | 4.05 | 3.75 | 3.95 |
| Outer shell | Specific gravity (b) | | 1.23 | 1.23 | 1.23 | 1.23 |
| Core | Diameter ($d_2$) | | 39.1 | 39.1 | 39.1 | 39.1 |
| | JIS-C hardness (Z) | | 87 | 87 | 83 | 85 |
| | Deformation amount (q) | | 3.48 | 3.30 | 3.10 | 3.22 |
| | Z-X | | 27 | 25 | 20 | 22 |
| | b-a | | 0.18 | 0.18 | 0.18 | 0.18 |

TABLE 4-continued

| Example | | | 1 | 2 | 3 | 4 |
|---|---|---|---|---|---|---|
| | p-q | | 0.87 | 0.75 | 0.65 | 0.73 |
| Cover Properties | Shore D hardness | | 58 | 58 | 55 | 51 |
| | Resilience | | 0.7633 | 0.7640 | 0.7622 | 0.7615 |
| | Flight performance | Launch Angle | 11.38 | 11.30 | 11.15 | 11.20 |
| | | Spin rate | 2724 | 2755 | 2828 | 2835 |
| | | Carry | 224.8 | 225.8 | 224.9 | 224.3 |
| | | Total | 244.7 | 245.1 | 243.8 | 242.6 |
| | Controllability | Spin rate | 6542 | 6558 | 6632 | 6882 |
| | | Carry | 35.1 | 34.9 | 34.8 | 34.7 |
| | | Run | 3.9 | 4.1 | 4.5 | 4.1 |
| | Shot feeling | ◎ | ◎ | ◎ | ◎ | |

TABLE 5

| Comparative Example | | | 1 | 2 | 3 | 4 | 5 | 6 | 7 |
|---|---|---|---|---|---|---|---|---|---|
| Center | JIS-C hardness | Center point X | 62 | 64 | 75 | 63 | 62 | 65 | 75 |
| | | 5 mm | 72 | 73 | 76 | 73 | 72 | 73 | 76 |
| | | 10 mm | 77 | 77 | 76 | 80 | 77 | 81 | 76 |
| | | 15 mm | 78 | 79 | 77 | 81 | 78 | 81 | 77 |
| | | Surface Y | 76 | 77 | 76 | 79 | 76 | 80 | 76 |
| | Y-X | | 14 | 13 | 1 | 16 | 14 | 15 | 1 |
| | Diameter ($d_1$) | | 25 | 31 | 32 | 32 | 35 | 32 | 32 |
| | Specific gravity (a) | | 1.05 | 1.25 | 1.05 | 1.05 | 1.05 | 1.05 | 1.05 |
| | Deformation amount (p) | | 4.00 | 3.85 | 3.70 | 3.75 | 4.05 | 3.55 | 3.70 |
| Outer shell | Specific gravity (b) | | 1.23 | 1.05 | 1.23 | 1.23 | 1.23 | 1.23 | 1.23 |
| Core | Diameter ($d_2$) | | 39.1 | 39.1 | 39.1 | 39.1 | 39.1 | 39.1 | 39.1 |
| | JIS-C hardness Z | | 87 | 83 | 83 | 77 | 85 | 80 | 87 |
| | Deformation amount (q) | | 3.05 | 3.04 | 3.15 | 3.24 | 3.25 | 3.10 | 2.80 |
| | p-q | | 0.95 | 0.81 | 0.55 | 0.51 | 0.80 | 0.45 | 0.90 |
| | Z-X | | 25 | 19 | 8 | 14 | 23 | 15 | 12 |
| | b-a | | 0.18 | −0.20 | 0.18 | 0.18 | 0.18 | 0.18 | 0.18 |
| Cover Properties | Shore D hardness | | 58 | 58 | 58 | 58 | 63 | 58 | 58 |
| | Resilience | | 0.7553 | 0.7505 | 0.7650 | 0.7560 | 0.7735 | 0.7650 | 0.7675 |
| | Flight performance | Launch Angle | 11.12 | 11.10 | 10.97 | 10.83 | 11.39 | 10.98 | 11.01 |
| | | Spin rate | 2788 | 2795 | 2892 | 2938 | 2724 | 2893 | 2897 |
| | | Carry | 222.3 | 220.2 | 222.9 | 221.3 | 226.3 | 222.5 | 222.8 |
| | | Total | 237.9 | 236.6 | 238.6 | 236.5 | 245.5 | 238.8 | 238.9 |
| | Controllability | Spin rate | 6561 | 6583 | 6591 | 6586 | 6132 | 6538 | 6530 |
| | | Carry | 34.9 | 34.8 | 34.9 | 34.8 | 35.6 | 34.7 | 34.5 |
| | | Run | 4.2 | 4.1 | 4.1 | 4.4 | 7.5 | 4.3 | 4.4 |
| | Shot feeling | | X | ◎ | Δ | ◎ | X | Δ | Δ |

The evaluation on the shot feeling is as follows. From the comparison between Example 1 and Comparative Example 1, it is found that the shot feeling is impaired when the center has a diameter $d_1$) of 27 mm or smaller, even if the center point hardness (X), the center surface hardness (Y), and the core hardness (Z) are respectively the same with each other. From the results of Comparative Examples 3 and 7, it is found that the shot feeling is impaired when the center point hardness (X) is excessively large and (Y−X) is smaller than 8, even if the center hardness (Y), the core surface hardness (Z), and the cover hardness D are not excessively large. From the comparison between Example 3 and Comparative Example 5, it is found that the shot feeling is impaired when the cover hardness D is larger than 60, even if (Y−X), the core surface hardness (Z), and the center diameter $d_1$) are respectively the same with each other.

The evaluation on the flight distance is as follows. From the results of Comparative Examples 3 and 7, it is found that when (Y−X) is less than 8, the spin rate is too high, thereby causing to shorten a flight distance, and the shot feeling is impaired. From the result of Comparative Example 3, it is found that when (Z−X) is small, the launch angle becomes small, and the flight distance is further shortened. However, the golf balls of Comparative Examples 3 and 7 have sufficient spin to stop quickly with a short run on the green when hit by an iron at an approach shot (i.e. good controllability).

The evaluation on the flight performance are as follows. From the result of Comparative Example 4, it is found that when the core surface hardness (Z) is less than 80, the golf ball has poor resilience and has too high spin to attain a long flight distance, even if (Y−X) is 8 or larger and (Z−X) is 10 or larger. From the result of Comparative Example 2, it is found that when the specific gravity (a) is larger than the specific gravity (b) (i.e. a>b), a long flight distance cannot be attained, notwithstanding appropriate launch angle and spin, because the relationship of the specific gravity (i.e. a>b) cause the resilience of the golf ball to decrease. From the result of Comparative Example 6, it is found that when (p−q) is smaller, the launch angle becomes lower and the spin rate becomes higher, resulting in shorter flight distance. However, the golf balls of Comparative Examples 2, 4, and 6 have sufficient high spin to stop quickly with a short run on the green when hit by an iron at an approach shot (i.e. good controllability).

From the result of Comparative Example 5, it is found that when the cover hardness D is larger than 60, the golf ball does not have enough spin to stop quickly on a green at an approach shot (i.e. poor controllability).

As seen in Table 4, the golf balls of Examples 1 to 4 satisfy the following requirements of the present invention: the center diameter ($d_1$) is in the range of 27 to 37 mm; the specific gravity (a) is smaller than the specific gravity (b); (Y−X) is 8 or larger; the core hardness (Z) is 80 or larger; (p−q) is 0.5 or larger; and a Shore D hardness of the cover is less than 60. The golf balls of Examples 1 to 4 attained a long flight distance while exhibiting a excellent controllability, and furthermore provided a excellent shot feeling.

What is claimed is:

1. A three-piece golf ball comprising:

a core having diameter of 38 to 41 mm consisting of a center which has a diameter of 27 to 37 mm, a specific gravity (a)

wherein the specific gravity (a) ranges from 1.0 to 1.2, a JIS-C hardness (X) at the center point thereof, a JIS-C hardness (Y) at a surface thereof satisfying the equation: $8 \leqq (Y-X) \leqq 25$, and a deformation amount (p) of the center when applying a load from 10 kgf as an initial load to 130 kgf as a final load thereto, and an outer shell placed-on the center, and having a specific gravity (b) satisfying the equation: $0.1 \leqq (b-a) \leqq 0.3$; and a cover placed on the core having a Shore D hardness in the range of 50 to 60, wherein a JIS-C hardness (Z) at a surface of the core is in the range of 82 to 90, the JIS-C hardness (Z) satisfying the equation: $10 \leqq (Z-X) \leqq 35$, and a deformation amount (q) of the core satisfies the equation: $0.5 \leqq (p-q) < 1.5$, when applying a load from 10 kgf as an initial load to 130 kgf as a final load to the core.

2. A three-piece golf ball comprising:

a core having diameter of 38 to 41 mm consisting of a center which has a diameter of 27 to 37 mm, a specific gravity (a)

wherein the specific gravity (a) ranges from 1.0 to 1.2, a JIS-C hardness (X) at the center point thereof, a JIS-C hardness (Y) at a surface thereof satisfying the equation: $8 \leqq (Y-X) \leqq 25$, and a deformation amount (p) of the center when applying a load from 10 kgf as an initial load to 130 kgf as a final load thereto, and an outer shell placed on the center, and having a specific gravity (b) satisfying the equation: $0.1 \leqq (b-a) \leqq 0.3$; and a cover placed on the core having a Shore D hardness in the range of 50 to 60 exclusive, wherein a JIS-C hardness (Z) at a surface of the core is 85 or larger, the JIS-C hardness (Z) satisfying the equation: $22 \leqq (Z-X) \leqq 35$, and a deformation amount (q) of the core satisfies the equation: $0.5 < (p-q) < 1.5$, when applying a load from 10 kgf as an initial load to 130 kgf as a final load to the core.

3. A three-piece golf ball comprising:

a core having diameter of 38 to 41 mm consisting of:

a center having a diameter of 27 to 37 mm, a specific gravity (a), a deformation amount (p) of the center when applying a load from 10 kgf as an initial load to 130 kgf as a final load thereto, and wherein the deformation amount (p) ranges from 3.0 to 5.0 mm, a JIS-C hardness (Y) at a surface thereto, which ranges from 70 to 90, and a JIS-C hardness (X) at the center point thereof in the range of 55 to 75 satisfying the equation: $10 \leqq (Y-X) \leqq 25$, an outer shell placed on the center, and having a specific gravity (b) which is larger than the specific gravity (a) wherein the specific gravity (a) ranges from 1.0 to 1.2 and the specific gravity (b) ranges from 1.10 to 1.30, and (b−a) is such that $0.1 \leqq (b-a) \leqq 0.3$; and a cover placed on the core having a Shore D hardness of less than 60, wherein a JIS-C hardness (Z) at a surface of the core is 82 to 95, and (Z−X) ranges from 10 to 35, and a deformation amount (q) of the core satisfies the equation: $0.5 \leqq (p-q) \leqq 1.5$, when applying a load from 10 kgf as an initial load to 130 kgf as a final load to the core.

4. A three-piece golf ball comprising:

a core having diameter of 38 to 41 mm consisting of:

a center having a diameter of 27 to 37 mm, a specific gravity (a), a deformation amount (p) of the center when applying a load from 10 kgf as an initial load to 130 kgf as a final load thereto, and wherein the deformation amount (p) ranges from 3.0 to 5.0 mm, a JIS-C hardness (Y) at a surface thereof, which ranges from 70 to 90, and a JIS-C hardness (X) at the center point thereof in the range of 55 to 75 satisfying the equation: $10 \leqq (Y-X) \leqq 25$, an outer shell placed on the center, and having a specific gravity (b) which is larger than the specific gravity (a) wherein the specific gravity (a) ranges from 1.0to 1.2 and the specific gravity (b) ranges from 1.10 to 1.30, and (b−a) is such that $0 \leqq (b-a) \leqq 0.3$; and a cover placed on the core having a Shore D hardness of less than 60, wherein a JIS-C hardness (Z) at a surface of the core is 85 or larger, and (Z−X) ranges from 22 to 35, and a deformation amount (q) of the core satisfies the equation: $0.5 \leqq (p-q) \leqq 1.5$, when applying a load from 10 kgf as an initial load to 130 kgf as a final load to the core.

5. A three-piece golf ball according to claims 3 or 4, wherein the specific gravity (a) and the specific gravity (b) satisfy the equation $(b-a) \geqq 0.1$.

* * * * *

UNITED STATES PATENT AND TRADEMARK OFFICE

CERTIFICATE OF CORRECTION

PATENT NO. : 6,390,935 B1 
DATED : May 21, 2002
INVENTOR(S) : Kazushige Sugimoto It is certified that error appears in the above-identified patent and that said Letters Patent is hereby corrected as shown below:

Column 15,
Line 33, please change “placed-on” to -- placed on --
Line 37, please insert “exclusive” after “60,”
Line 42, please change “$0.5 \leq (p-q) < 1.5$” to -- $0.5 \leq (p-q) \leq 1.5$ --

Column 16,
Line 4, please change “$0.5 \leq (p-q) < 1.5$” to -- $0.5 \leq (p-q) \leq 1.5$ --
Line 45, please change “1.0to” to -- 1.0 to --
Line 47, please change “$0 \leq (b-a) \leq 0.3$” to -- $0 < (b-a) \leq 0.3$ --

Signed and Sealed this

Twenty-first Day of October, 2003

JAMES E. ROGAN
*Director of the United States Patent and Trademark Office*